United States Patent [19]

Howell, Jr.

[11] 3,952,372

[45] Apr. 27, 1976

[54] METHOD AND MEANS FOR BLENDING FIBER STRAND SEGMENTS IN A BASE STRAND

[75] Inventor: Robert Lewis Howell, Jr., Fayetteville, N.C.

[73] Assignees: Holt Williamson Mfg. Co., Fayetteville; Davant Yarns, Inc., Charlotte, both of N.C.

[22] Filed: June 3, 1974

[21] Appl. No.: 475,572

[52] U.S. Cl. ..... 19/243; 19/238; 19/258

[51] Int. Cl.[2] ..... D01H 5/00

[58] Field of Search ..... 19/237, 238, 236, 258, 19/244, 243, 150, 157, .35, 288, 291; 57/36; 161/172, 177, 179

[56] References Cited

UNITED STATES PATENTS

| | | | |
|---|---|---|---|
| 207,272 | 8/1878 | Haigh | 19/145.7 |
| 1,313,164 | 8/1919 | Casablancas | 19/288 X |
| 1,668,333 | 5/1928 | Oxley | 19/288 X |
| 2,069,446 | 2/1937 | Horner | 19/238 |
| 2,953,823 | 9/1960 | Lynch, Jr. | 19/157 |
| 3,789,461 | 2/1974 | Nakano et al. | 19/.35 |
| 3,814,660 | 6/1974 | Naegeli | 161/177 X |

*Primary Examiner*—Dorsey Newton
*Attorney, Agent, or Firm*—Richards, Shefte & Pinckney

[57] ABSTRACT

An unpredictable random distribution of segments of supplemental strands of fiber are produced in a base strand by pulling segments from the supplemental strands and adding them to the base strand. The segments are pulled from free extents of the supplemental strands that have a free length longer than the length of the fibers of the supplemental strands, and the supplemental strands advance slower than the base strand, with the result that the size and occurrence of the pulled segments in the base strand are unpredictably random. Preferably, a draw frame is used, to which is added a feed unit having a pair of rotating feed rolls for feeding the supplemental strands to the next-to-last pair of drafting rolls that have a surface speed greater than the feed rolls and are spaced therefrom a distance greater than the length of fibers in the supplemental strands. Thus, the drafting rolls pull segments or tufts from the supplemental strands and add them to the base strand for blending therein during subsequent drawing and other processing of the composite strand.

10 Claims, 5 Drawing Figures

METHOD AND MEANS FOR BLENDING FIBER STRAND SEGMENTS IN A BASE STRAND

BACKGROUND OF THE INVENTION

The present invention relates to adding of fiber strand segments of varied colors, textures or other characteristics into a composite strand of fibers such as used in the manufacture of textile yarn to make fabrics having varying colors, textures or other characteristics distributed throughout their extent, and more particularly the present invention relates to producing such strands having the colors, textures or other characteristics distributed in a truly random manner without repeats in the ultimate Multi-colored, multi-textured and otherwise multi-charactered woven or knitted textile fabrics have been manufactured for years in various ways and have become popular in carpets, garments, draperies and other products. In recent years there has been a growing demand for fabrics having colors, textures or other characteristics in a truly random distribution, without any predictable repeat in the finished fabric. Repeats are difficult to avoid with certainty because even a long and complicated pattern that is difficult to discern in a length of yarn is compacted into what may be a detectible repeat when the yarn is knit or woven into fabric.

Prior attempts to obtain true random distribution have evolved into complicated and expensive electronic control systems for varying the addition of components to fiber strands, such as shown in Cureton U.S. Pat. No. 3,449,899, issued June 17, 1969, for Variable Count and Slubbing Apparatus and Method. Other examples of adding segments of fibers to a fiber strand, in each case a yarn, with only a modicum of elimination of patterning and requiring special apparatus are disclosed in Joy U.S. Pat. No. 3,310,933, issued Mar. 28, 1967, which discloses a timer controlled cutter and air jet to insert slubs into a yarn, and Breen U.S. Pat. No. 2,997,837, issued Aug. 29, 1961, which discloses imparting a cranking motion to a yarn to pick up slubs discharged from a reservoir. None of these prior art examples or any other known prior art provides unpredictable random distribution of fiber strand segments in a base strand in a simple and inexpensive manner as does the present invention.

SUMMARY OF THE INVENTION

Briefly described, the present invention provides for adding segments of a supplemental strand or strands of fibers of one or more colors, textures or other characteristics into a base strand of fibers of one or more other colors, textures or characteristics to produce a composite strand with an unpredictable random distribution of the supplemental strand segments therein. The invention includes separately advancing the base strand and one or more of the supplemental strands, pulling from the supplemental strand segments of lengths greater than the length of the individual fibers thereof, and adding the pulled segments to the advancing base strand for incorporation therein to form the composite strand. By the aforementioned pulling, the segments are drawn from the supplemental strands with a random indiscriminate separation from the supplemental strand as the separating fibers drew on each other and the segments taper to thin ends. This indiscriminate ending and corresponding random length of the pulled segments is assured by pulling in length greater than the fiber length and is further enhanced by the preferred slower advance of the supplemental strands than the base strands so that the segments are pulled and added to the faster advancing base strand in a more positive drawing separation from the supplemental strands.

The unpredictable random distribution results to the generally same extent when using a plurality of supplemental strands without interrelation, in which case the segments pulled from one strand are of unpredictable length and unrelated in size and occurrence to the segments pulled from the other strands.

For simplicity, the pulling of the segments from the supplementary strands and the adding of the pulled segments to the base strand are performed simultaneously by the same means, such as by a pair of existing drafting rolls that conventionally serve to advance the base strand.

In the preferred embodiment the invention is adapted for use with a conventional roving or drawing frame or the like wherein the base strand or strands are advanced and attenuated by drafting or drawing through a plurality of progressively faster rotating pairs of drafting rolls. The supplemental strand or strands are advanced by a pair of feed rolls mounted on the frame above the level of the next-to-last pair of drafting rolls, to which the supplemental strands are fed and which drafting rolls both pull the segments from the supplemental strand and add the pulled segments to the base strand in addition to performing their conventional function in drafting of the base strands. In this preferred embodiment the pair of feed rolls are spaced from the next-to-last pair of drafting rolls a distance greater than the length of fibers in the supplemental strands to provide a free extent of strands sufficient to be pulled in segments of lengths longer than the fiber lengths. Also, the feed rolls rotate at a surface speed less than the surface speed of the next-to-last drafting rolls to facilitate pulling of the segments by the faster drafting rolls from the slower moving supplemental segments.

Thus, the present invention provides a simple and inexpensive method and means for effectively adding randomly varied colors, textures or other characteristics in a textile fiber strand.

DESCRIPTION OF THE PREFERRED EMBODIMENT

Figure 1:
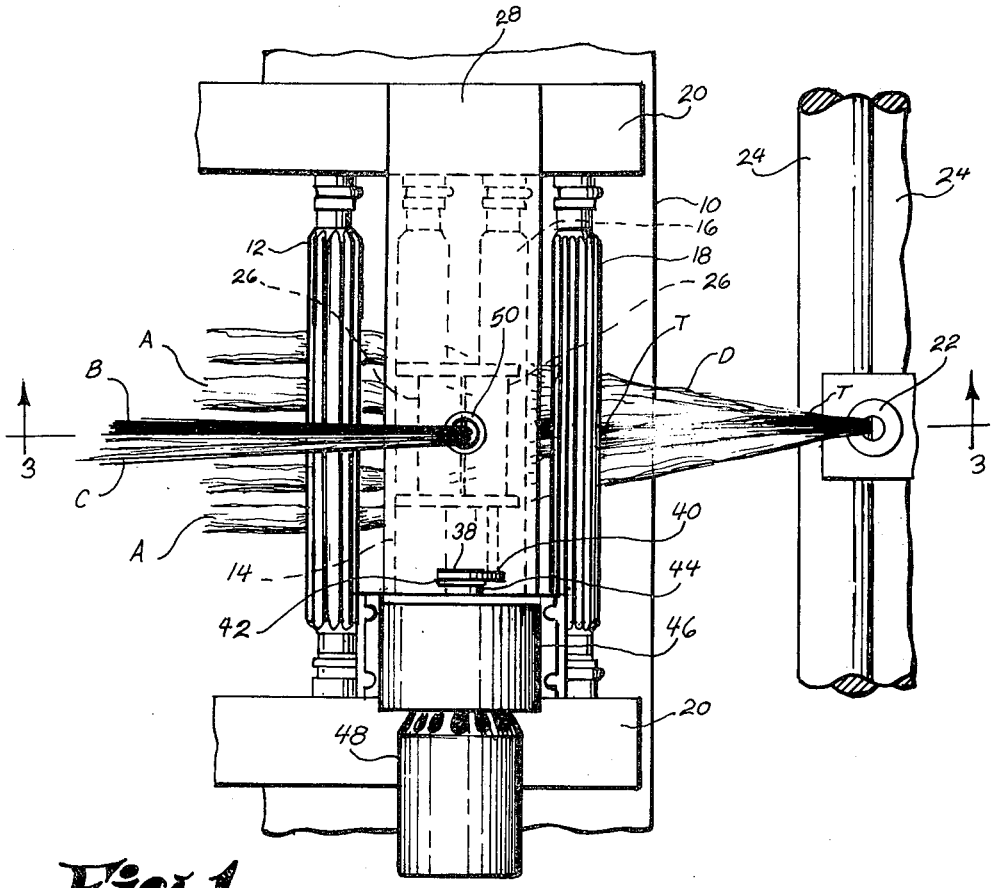
FIG. 1 is a plan view of a textile draw frame in which the preferred embodiment of the present invention is incorporated.
Figure 3:
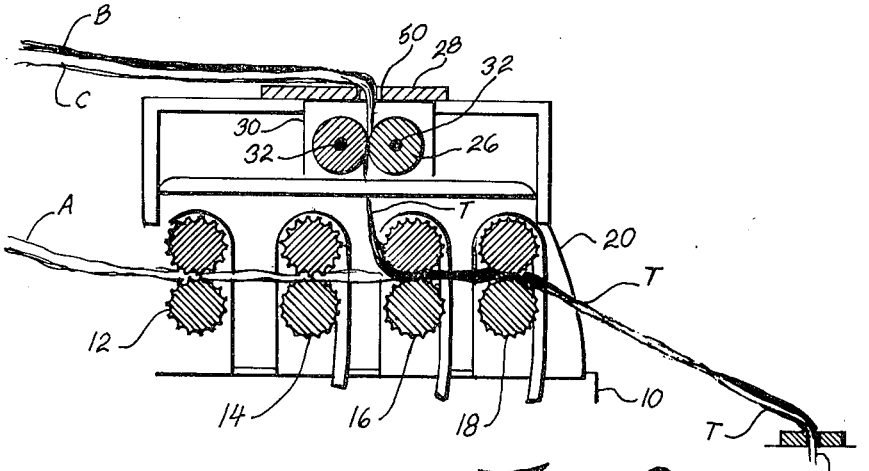
FIG. 3 is a vertical sectional view taken along line 3–3 of FIG. 1.
Figure 2:
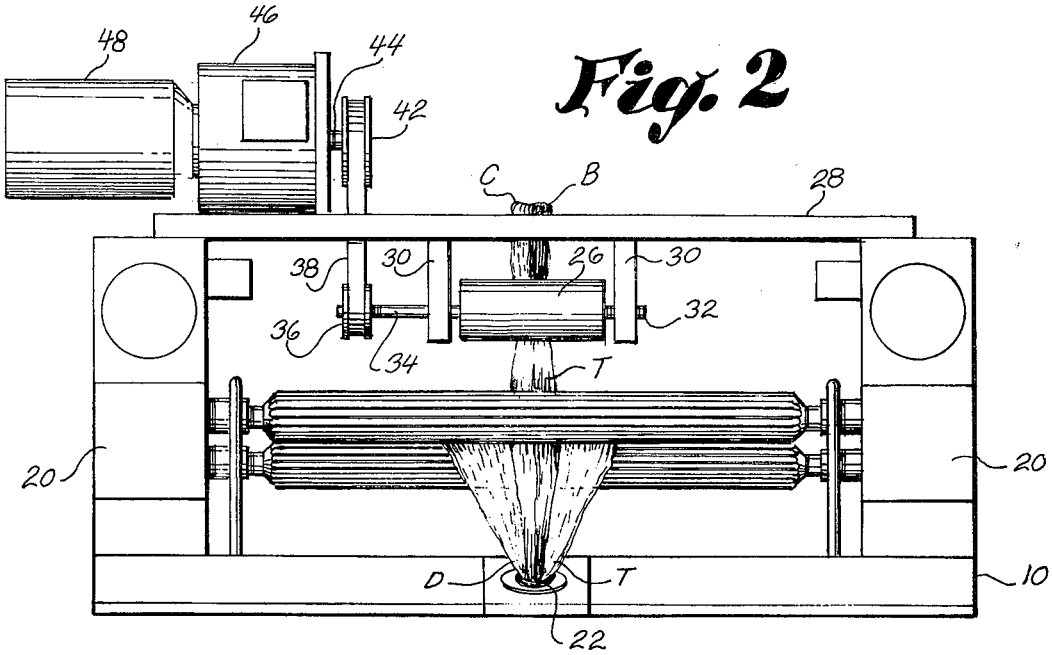
FIG. 2 is a front elevation of the draw frame of FIG. 1.
Figure 4:
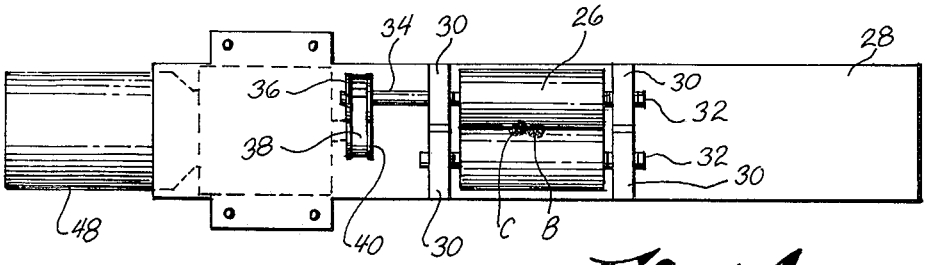
FIG. 4 is a bottom view of the feed unit of the present invention that is incorporated in the draw frame of FIG. 1.

In the preferred embodiment illustrated in the accompanying drawings, the method and means of the present invention are practiced with and incorporated in a conventional draw frame of the type presently in common use in the industry. The particular draw frame illustrated is marketed by Ideal Industries, Inc. of Bessemer City, N.C.

It should be noted, however, that the concept of the present invention is applicable, not only to use in draw frames, but in roving frames, spinning frames or in any similar processing of strands of fiber material, including slivers, rovings or yarns of natural fibers, such as cotton or wool, in which case the wool strands corresponding to rovings are called tops, or any of various synthetic fibers. In this regard, the term "drafting rolls" as used throughout the present specification and claims is intended to include any rolls that perform a drafting, drawing, spinning or blending function at a stage of textile yarn production.

In the various systems for producing spun yarn from cotton or synthetic fibers, carded fibers are formed into slivers, which are large strands of loosely combined fibers. The slivers are then doubled, drafted and twisted to form rovings, which in turn are drafted and twisted into finer rovings, and are finally drafted and twisted by spinning operations to form the finished yarn. The elongation of sliver and roving strands and yarn during drafting is accomplished by passing the strands between pairs of drafting rolls arranged in a sequence with the first pair of drafting rolls being driven at a lower speed than the last pair.

As illustrated in the drawings, the draw frame 10 of the conventional type illustrated has four pairs of fluted drafting rolls, the first being designated by the numeral 12, the second by the numeral 14, the next-to-last by the numeral 16, and the last by the numeral 18. These pairs of rolls are mounted on the draw frame 10 with their ends journalled for rotation in upstanding bearing stands 20. Conventional gearing is contained in the bearing stands to transmit rotation from a conventional power source to the pairs of drafting rolls, 12, 14, 16 and 18, with the gearing rotating each pair of rolls faster than the preceding pair. Thus, the pairs of rolls, 12, 14, 16 and 18, are arranged as a horizontal plurality of progressively faster rotating pairs of drafting rolls. As a plurality of base strands in the form of slivers A are fed to and advanced sequentially through the drafting rolls they will be attenuated to emerge substantially thinner and traveling correspondingly faster. As they emerge converge to pass through a ring or trumpet 22 that gathers all of the base strands A into a combined silver that then passes through a pair of calender rolls 24, after which the newly combined sliver will be further processed into rovings and ultimately drafted and twisted into yarn of whatever degree of fineness is desired for the particular knitting or weaving usage to which the yarn is intended.

The foregoing description relates to a conventional draw frame construction and operation, and it is with this that the method of the present invention is practiced and that the means of the present invention are incorporated. No modification of the existing frame construction is required; all that is necessary is the mounting of a feed unit on the frame 10 with a pair of supplemental strand feed rolls 26 and a related drive mechanism. This is accomplished by mounting a supporting platform 28 on the bearing stands 20 for extension across the frame above the second and next-to-last drafting rolls, 14 and 16, respectively. Two pairs of mounting plates 30 are secured to and depend from the underside of the platform 28 between the bearing stands 20, with the plates of each pair spaced from each other sufficient to mount the feed rolls 26 therebetween on horizontal shafts 32 that are journalled in the mounting plates 30 in parallel horizontal relation for downward feeding action of the feed rolls 26.

One of the feed roll shafts 32 extends laterally beyond the mounting plate 30 to provide a drive connection section 34 that has a timing pulley 36 fixed on its extending end. A timing belt 38 is trained around the pulley 36 and extends through an opening 40 in the platform 28 and around a timing pulley 42 mounted on a drive shaft 44 extending from the gear box 46 of a drive motor assembly 48 that is mounted on the top surface of the platform 28 at one side thereof adjacent one of the bearing stands 20. Thus, the drive motor assembly 48 rotates the drive pulley 42 to drive the belt 38 and pulley 36, thereby imparting rotation to the feed rolls 26.

The feed rolls 26 are of a length sufficient to accommodate and feed supplemental strands or slivers of different color, texture or other characteristics from that of the base slivers A. There may be one or more of these supplemental slivers and they may each have different color, texture or other characteristics. In the embodiment illustrated there are two such supplemental strands or slivers B and C of different colors. These supplemental slivers are fed from a conventional supply, such as a can or a creel and passed downwardly through a central ring opening 50 in the platform 28 directly above the feed rolls 26 through which the supplemental slivers B and C pass downwardly into the space between the second pair of drafting rolls 14 and the next-to-last pair of drafting rolls 16 to the level of the base slivers A with which the supplemental slivers B and C pass into the nip of the next-to-last pair of drafting rolls 16. The nip of the feed rolls 26 is spaced from the nip of the next-to-last pair of drafting rolls 16 a distance greater than the length of the individual fibers of the supplemental slivers B and C so that the next-to-last pair of drafting rolls 16 can pull segments or tufts T from the supplemental slivers B and C of lengths greater than the individual fiber length. This tufted pulling also results from a controlled relation of the surface speeds of the feed rolls 26 and the next-to-last pair of drafting rolls 16 so that the supplemental slivers B and C are advanced at a slower rate than the base slivers A, whereby the next-to-last pair of drafting rolls 16 will pull or snatch the tufts T away from the supplemental slivers B and C.

The next-to-last pair of drafting rolls 16 also functions as means for adding the pulled tufts T to the base slivers A as both must pass through these drafting rolls and are thereby combined to incorporate the tufts T in the base slivers A to form a composite strand or sliver D. This incorporation is further enhanced by the drafting or drawing that occurs between the next-to-last pair of drafting rolls 16 and the last pair of drafting rolls 18, which causes the tufts T to be drafted into the composite sliver D. Thereafter the composite sliver D passes from the last pair of drafting rolls 18 and converges to form a single strand as it passes through the aforementioned trumpet 22 and leaves the draw frame 10.

The tufts T pulled from the supplemental slivers B and C are roughly of lengths somewhat longer than the length of the fibers therein with there being no consistency or regularity to these tuft lengths because of the pulling nature of the separation of the tufts from the original sliver strands. The spacing between the nips of the next-to-last pair of drafting rolls 16 and the pair of feed rolls 26 assures a free extent of the supplemental slivers B and C greater than the fiber length so that full length fibers can be separated in the tufts T, but as the fibers are randomly distributed in the strand they will separate irregularly and will be drafted and thinned at their ends without any predictability and greater or lesser amounts of fibers will be pulled with each tuft, thereby providing an upredictable random size and occurrence of tuft formation that carries over into the finished yarn and ultimate fabric. The size and extent of the tufts T and the degree of thinning is variable to some extent by the spacing of the rolls and the relative surface speeds of the rolls. Thus, an increase in the spacing to increase the free extent of the strand will to some degree allow a greater drawing and more gradual thinning of the ends of the pulled tufts, while a reduction in the surface speed of the feed roll 26 in comparison with the next-to-last drafting rolls 16 will create more of a snatching action to pull the turfs more sharply from the strand with less trailing or thinning. The relative surface speed is adjusted by adjusting the drive motor assembly 48 to increase or decrease the speed of the feed rolls 26, and the spacing between rolls is varied by raising or lowering of the platform 28 mounting on the bearing strands 28, which can be accomplished by inserting or removing spacer blocks that may be mounted between the platform 28 and the bearing stands 20.

By selection of these variables, it is possible to pull tufts cleanly and sharply from the supplemental slivers with a recognizable space between the tufts in the composite strand D and in the ultimate yarn and fabric, or it is possible to pull the tufts slowly from the sliver so that the drafting effect retains at least a thin fiber connection between adjacent tufts with a resulting alternating thick and thin tuft distribution in the composite strand and ultimate yarn and fabric.

The unpredictable random distribution is further accentuated by feeding two or more supplemental slivers B and C without any interrelation, which is as shown in the illustrated embodiment. As the slivers are not twisted together or otherwise combined, the random fiber distribution in the separate supplemental slivers will result in unrelated size and occurrence of tuft formation, with the tufts pulled from one sliver sometimes being somewhat oriented with the tufts pulled from the other sliver and at other times being partially out of phase and at still other times being completely out of phase. This completely unpredictable random distribution and combination is naturally carried forward on an elongated basis into the finished yarn and fabric.

Figure 5:
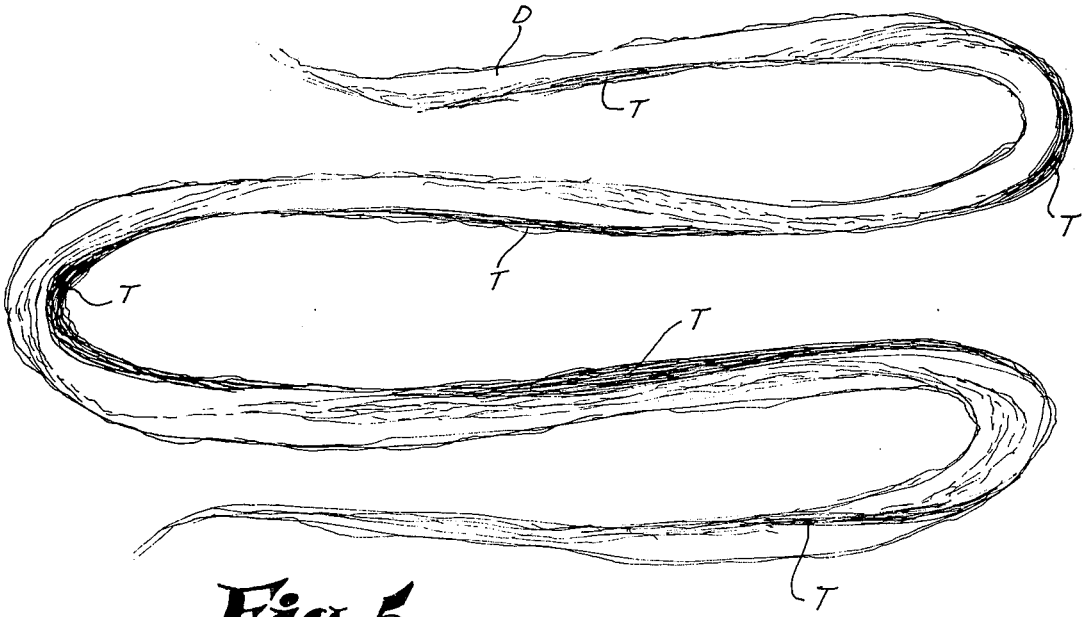
FIG. 5 is an illustration of a typical composite strand that has been blended and drafted by the draw frame of FIG. 1.

When the present invention is practiced at the draw frame stage, the tuft, though short when pulled, will be attenuated during subsequent drafting and spinning to a length of several feet, throughout which there will be a gradual thickening and then thinning followed by an absence of any tuft fibers and then a thickening and thinning produced by the next tuft with the extent and occurrence of these characteristics being determined generally, but not pattern formingly, by the relative speed and spacing variables mentioned herein above. FIG. 5 illustrates a sliver strand, such as the composite strand D issuing from the illustrated draw frame 10, with the tufts T shown in their somewhat attenuated and unpredictably random distribution. This composite strand will be further drawn and spun with the tuft fibers being mixed with the other fibers into a homogeneous blend to give a uniform appearance throughout each cross-section.

The length and size of the tufts T in the finished yarn can also be varied by practicing this blending concept at other stages of processing. If it is practiced at a spinning stage there is much less further drafting to form the finished yarn and the tufts will, therefore, be much shorter in the final yarn, and as the supplemental strand used in a spinning frame would be the same as the base strand it would itself have been drafted and twisted and therefore would separate more sharply into tufts than when tufts are pulled from a sliver or roving strand. The desired tufts distribution can be varied between the early processing stages and the final processing stages as desired to obtain the degree of tuft distribution demanded.

In a typical commercial installation of the presently illustrated and described preferred embodiment of the present invention, the base slivers A and supplemental slivers B and C are produced with fibers having an average length of 1½ inches and the space between the nip of the pair of feed rolls 26 and the nip of the next-to-last pair of drafting rolls 16 is 2⅞, inches, with the feed rolls 26 rotating at a speed of 50 feet per minute and the next-to-last pair of draft rolls 16 rotating at a speed of 269 feet per minute to provide a draft therebetween of 5.38. The first pair of drafting rolls 12 rotates at a surface speed of 99 feet per minute and the second pair of drafting rolls 14 rotates at a surface speed of 143 feet per minute, producing a draft of 1.44 over the 1⅞ inches spacing between the nips of these pairs of rolls, which is the same spacing as between the second pair of drafting rolls 14 and the next-to-last pair of drafting rolls 16. The draft between the second pair of drafting rolls 14 and the next-to-last pair of drafting rolls 16 is 1.88, and the draft between the next-to-last pair of drafting rolls 16 and the last pair of drafting rolls 18 is 2.76, which is produced by the 269 feet per minute surface speed of the next-to-last pair of drafting rolls 16 and a surface speed of 742 feet per minute for the last pair of drafting rolls 18. The spacing between the next-to-last pair of drafting rolls 16 and the last pair of drafting rolls 18 is 1 11/16 inches. In the further processing following the drafting on this draw frame, typical drafting and spinning will attenuate the strand about 40 times the length of the tufts when originally pulled so that a tuft of about 3 inches when pulled from the supplemental slivers will extend over a length of about 120 inches in the finished yarn, with a general increase in thickness toward the center of that extent and a corresponding decrease toward each end.

For a supplemental sliver or slivers having fiber lengths of 1½ inches, a free extent between nips of the feed rolls 26 and next-to-last drafting rolls 16 1¾ inches is found to be a practical minimum, while a spacing of 2⅞ inches is considered optimum. The spacing can be increased and has been increased incrementally up to 6½ inches without substantial disadvantage, probably due to the fact that the tufts are pulled at about the fiber length spacing from the nip of the next-to-last pair of drafting rolls 16 and after an optimum free extent is provided any additional spacing has no appreciable effect. However, there may be some interrelation between relative speed and spacing to obtain effective separation of tufts or merely thinning and thickening of connected tufts. As the difference in surface speeds between the rolls is reduced the extent of separation or thinning of the tufts is similarly reduced to the point of ineffectiveness when the speeds are close enought to result in only drafting of the supplemental sliver uniformly without tuft formation. When such results would occur in given circumstance would depend upon the fiber length, relative speeds, and nip spacings.

In the preferred embodiment adding of differently colored tufts T are shown, but differently textured tufts may be used instead for desired fabric effects, or other tuft characterics, such as dying affinity or surface finish, may be used as the variable.

In summary, the present invention as described and illustrated herein provides effective and advantageous adding of strand segments in an unpredictable random distribution and does so in a simple and inexpensive manner. Moreover, it is capable of variation to produce a wide range of desired results.

The present invention has been described in detail above and illustrated herein for purposes of disclosure only and is not intended to be limited by this description or otherwise to exclude any variation or equivalent arrangement or usage that would be apparent from, or reasonably suggested by, the foregoing disclosure to the skill of the art.

I claim:

1. A method of adding segments of at least one supplemental strand of fibers of at least one characteristic of color, texture and construction into at least one base strand of fibers of at least one other characteistic of color, texture and construction to produce a composite strand of blended fibers with an unpredictable random distribution of said supplemental strand segments therein, said method comprising separately and continuously advancing said at least one base strand and said at least one supplement strand indiscriminately pulling from said at least one supplemental strand segments of lengths greater than the length of individual fibers thereof and of unpredictably random size and occurrence, adding said pulled supplemental strand segments to said advancing at least one base strand for incorporation therein to form a composite strand, and in advancing said at least one base strand during adding of said pulled supplemental strand segments thereto said at least one base strand is attenuated by drafting.

2. A method of adding segments of at least one supplemental strand into at least one base strand according to claim 1 and characterized further in that at least two different supplemental strands are advanced and pulled without interrelation of said supplemental strands, thereby resulting in unrelated occurrence and size of the segments pulled from the different supplemental strands and added to the at least one base strand.

3. A method of adding segments of at least one supplemental strand into at least one base strand according to claim 1 and characterized further in that in separately and continuously advancing said at least one base strand and said at least one supplemental strand the supplemental strand is advanced slower than the at least one base strand.

4. A method of adding segments of at least one supplemental strand into at least one base strand according to claim 1 and characterized further in that said drafting of said at least one base strand is continued subsequent to adding of said supplemental strand segments thereto, said continued drafting thereby facilitating the incorporation of said segments in said at least one base strand.

5. A method of adding segments of at least one supplemental strand into at least one base strand according to claim 1 and characterized further in that said pulling and adding of each said supplemental strand segment to the drafted base strand is performed simultaneously with said adding of the pulled segments.

6. A method of adding segments of at least one supplemental strand into at least one base strand according to claim 1 and characterized further in that said advancing of said at least one supplemental strand are performed at locations spaced apart a distance greater than the length of individual fibers of said at least one supplemental strand.

7. A method of adding segments of at least one supplemental strand into at least one base strand according to claim 1 and characterized further in that advancing of said at least one base strand is performed by feeding said at least one base strand through a plurality of progressively faster rotating pairs of drafting rolls and adding of said supplemental strand segments is performed between two of said pairs of drafting rolls.

8. A method of adding segments of at least one supplemental strand into at least one base strand according to claim 7 and characterized further in that in advancing said at least one supplemental strand it is advanced to said one pair of drafting rolls, and said pulling of segments from said at least one supplemental strand is performed by said one pair of said two pairs of drafting rolls.

9. A method of adding segments of at least supplemental strand into at least one base strand according to claim 8 and characterized further in that said drafting of said at least one supplemental strand is performed by a pair of rotating feed rolls through which said at least one supplemental strand is fed, said feed rolls being spaced from said one pair of drafting rolls a distance greater than the length of individual fibers of said at least one supplemental strand.

10. A method of adding segments of at least one supplemental strand into at least one base strand according to claim 9 and characterized further in that drafting of said at least one strand is performed on a draw frame and said one pair of drafting rolls is the next-to-last pair of drafting rolls through which said at least one base strand advances so that drafting of the composite strand will be performed between said one pair of drafting rolls and the last pair of drafting rolls to enhance combining of said segments in said at least one base strand.

* * * * *

UNITED STATES PATENT OFFICE
CERTIFICATE OF CORRECTION

Patent No. 3,952,372 Dated April 27, 1976

Inventor(s) Robert Lewis Howell

It is certified that error appears in the above-identified patent and that said Letters Patent are hereby corrected as shown below:

The title of the patent should be --METHOD OF ADDING FIBER STRAND SEGMENTS IN A BASE STRAND--; Column 1, line 15, after "ultimate" insert --fabric--; Column 1, line 65, "drew" should be --draw--; Column 1, line 68, after "in" insert --a--; Column 3, line 45, after "emerge" insert --they--; Column 3, line 47, "silver" should be --sliver--; Column 7, line 4, after "in" insert --a--; Column 7, line 10, "characterics" should be --characteristics--; Column 7, line 35, "supplement" should be --supplemental--.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*